US008142912B1

(12) United States Patent
Chang et al.

(10) Patent No.: US 8,142,912 B1
(45) Date of Patent: Mar. 27, 2012

(54) COATING, ARTICLE COATED WITH COATING, AND METHOD FOR MANUFACTURING ARTICLE

(75) Inventors: Hsin-Pei Chang, Tu-Cheng (TW); Wen-Rong Chen, Tu-Cheng (TW); Huann-Wu Chiang, Tu-Cheng (TW); Cheng-Shi Chen, Tu-Cheng (TW); Chuang Ma, Shenzhen (CN)

(73) Assignees: Hong Fu Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 13/031,709

(22) Filed: Feb. 22, 2011

(30) Foreign Application Priority Data

Oct. 6, 2010 (CN) ..... 2010 1 0299025

(51) Int. Cl.
*B32B 9/00* (2006.01)
*B32B 19/00* (2006.01)

(52) U.S. Cl. ..... 428/698; 428/699

(58) Field of Classification Search ..... 428/698, 428/699
See application file for complete search history.

(56) References Cited

U.S. PATENT DOCUMENTS 6,573,209 B1 * 6/2003 Sambasivan et al. ..... 501/96.1
2002/0069690 A1 * 6/2002 Liden et al. ..... 73/7
2006/0147728 A1 * 7/2006 Shen et al. ..... 428/446
2007/0298282 A1 * 12/2007 Andersson et al. ..... 428/698
2008/0260478 A1 * 10/2008 Hovsepian et al. ..... 407/119

OTHER PUBLICATIONS

Polakova et al., "Control of Structure in magnetron sputtered thin films", Surface and Coatings Technology, vol. 142-144, 2001, pp. 201-205.*

Soukup et al., "Effect of Ti Interlayer and Bias on Structure and Properties of TiN Films", Czechoslovak Journal of Physics, vol. 50, No. 5., 2000, pp. 655-663.*

Dobrzanski et al., "Mechanical properties of monolayer coatings deposited by PVD techniques", Journal of Achievements in Materials and Manufacturing Engineering, col. 20, Iss. 1-2, 2007, pp. 423-426.*

Musil et al., "Hard and superhard nanocomposite coatings", Surface and Coatings Technology, vol. 125, Issues 1-3, Mar. 2000, pp. 322-330.*

Zywitski et al., Structure of superhard nanocrystalline (Ti,Al)N layers deposited by reactive pulsed magnetron sputtering, Surface and Coatings Technology, vol. 200, Issues 22-23, Jun. 20, 2006, pp. 6522-6526.*

Definition of Superlattice from http://en.wikipedia.org/wiki/Superlattice, internet retrieval date Oct. 25, 2011.*

* cited by examiner

*Primary Examiner* — Jonathan Langman
(74) *Attorney, Agent, or Firm* — Altis Law Group, Inc.

(57) ABSTRACT

A coating includes a nano-composite layer including a plurality of stacked films. Each film includes a zirconium nitride layer and a zirconium yttrium nitride layer.

18 Claims, 3 Drawing Sheets

COATING, ARTICLE COATED WITH COATING, AND METHOD FOR MANUFACTURING ARTICLE

BACKGROUND

1. Technical Field

The exemplary disclosure generally relates to coatings, and particularly relates to articles coated with the coatings and a method for manufacturing the articles.

2. Description of Related Art

Physical vapor deposition (PVD) has conventionally been used to form a coating on metal bases of cutting tools or molds. Materials used as this coating material are required to have excellent durability. At present, Titanium nitride (TiN) and Titanium-aluminum nitride (TiAlN) are mainly used as a material satisfying these requirements. However, these coating materials have a poor adhesion to metal bases and may be easily peeled off.

Therefore, there is room for improvement within the art.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the exemplary coating, article coated with the coating and method for manufacturing the article. Moreover, in the drawings like reference numerals designate corresponding parts throughout the several views. Wherever possible, the same reference numbers are used throughout the drawings to refer to the same or like elements of an embodiment.

DETAILED DESCRIPTION

Figure 1:
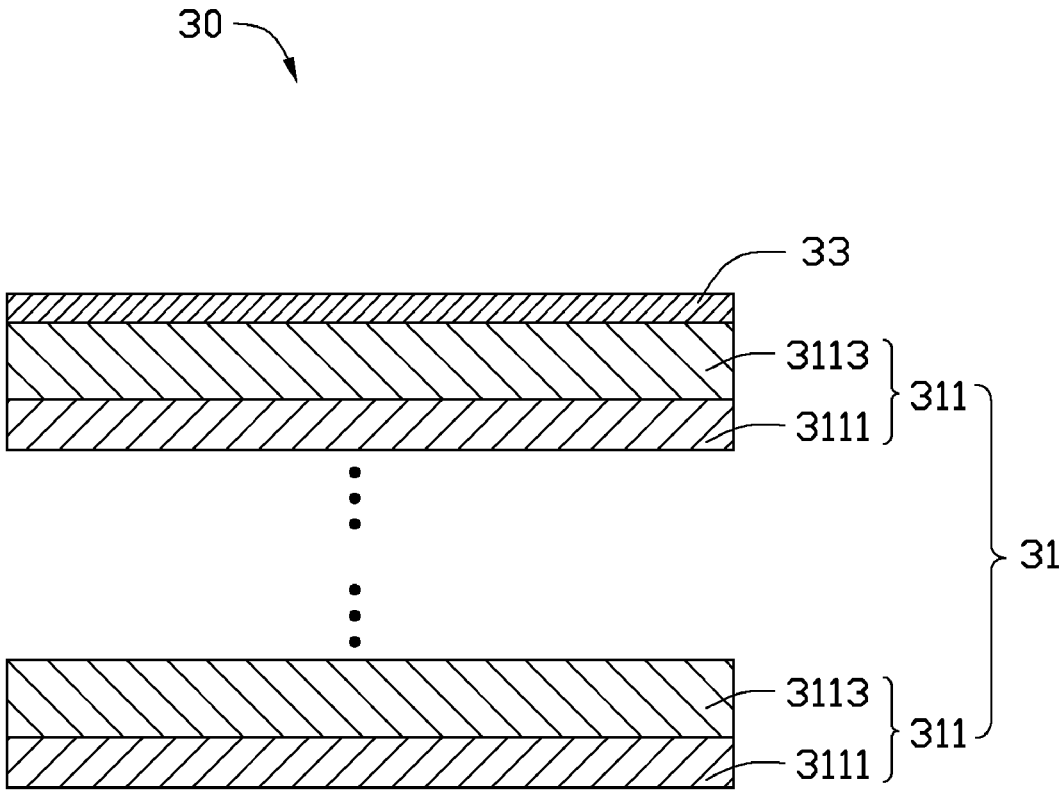
FIG. 1 is a cross-sectional view of an exemplary embodiment of a coating.

Referring to FIG. 1, a coating 30 includes a nano-composite layer 31, which comprises a plurality of stacked films 311. Each film 311 includes a zirconium nitride (ZrN) layer 311 and a zirconium yttrium nitride (ZrYN) layer 313. In other words, the nano-composite layer 31 includes an equal number of alternating ZrN layers 311 and ZrYN layers 313. The ZrN layers 311 and the ZrYN layers 313 may be deposited by magnetron sputtering.

In this exemplary embodiment, the number of the films 311 is about 20~50. Each ZrN layer 311 has a thickness of about 10 nanometers to about 20 nanometers. Each ZrYN layer 313 has a thickness of about 10 nanometers to about 20 nanometers. The coating 30 has a thickness of about 1 micrometer to about 4 micrometers. The coating 30 may also include a color layer 33 covering the nano-composite layer 31, to decorate the coating 30.

Figure 2:
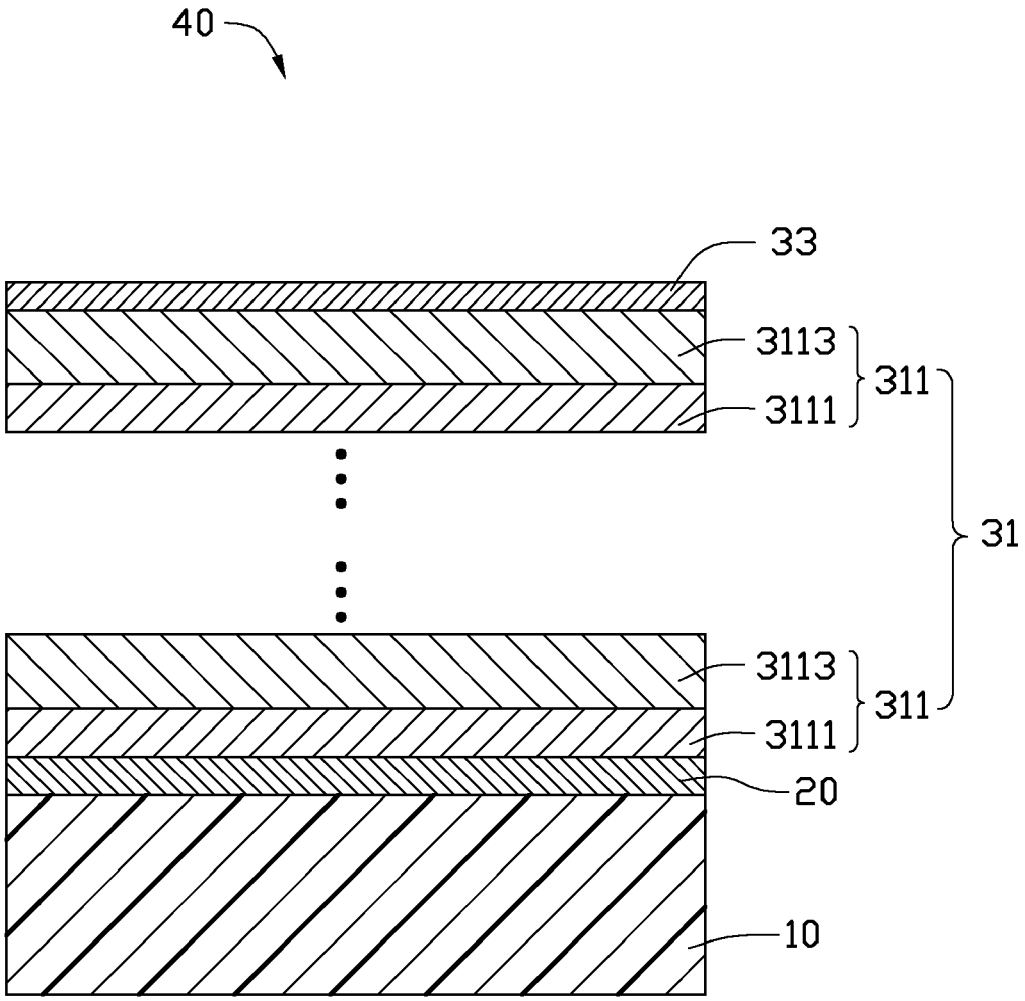
FIG. 2 is a cross-sectional view of an article coated with the coating in FIG. 1.

Referring to FIG. 2, an exemplary article 40 includes a substrate 10, a bonding layer 20 deposited on the substrate 10 and the coating 30 deposited on the bonding layer 20. The substrate 10 may be made of metal, such as high speed steel, hard alloy, or stainless steel. The article 40 may be a cutting tool, a mold, or a housing for an electronic device. The bonding layer 20 is a zirconium yttrium (ZrY) layer. The bonding layer 20 has a thickness of about 0.05 micrometers to about 0.2 micrometers, and in this exemplary embodiment has a thickness of 0.1 micrometer. The bonding layer 20 can be deposited by magnetron sputtering. The chemical stability of the bonding layer 20 is between the chemical stability of the substrate 10 and the chemical stability of the coating 30, and the coefficient of thermal expansion of the bonding layer 20 is between the coefficient of thermal expansion of the substrate 10 and the coefficient of thermal expansion of the coating 30. Thus, the bonding layer 20 improves the binding force between the substrate 10 and the coating 30 so the coating 30 can be firmly deposited on the substrate 10. The coating 30 contacts with the bonding layer 20 via ZrN layer 311.

Figure 3:
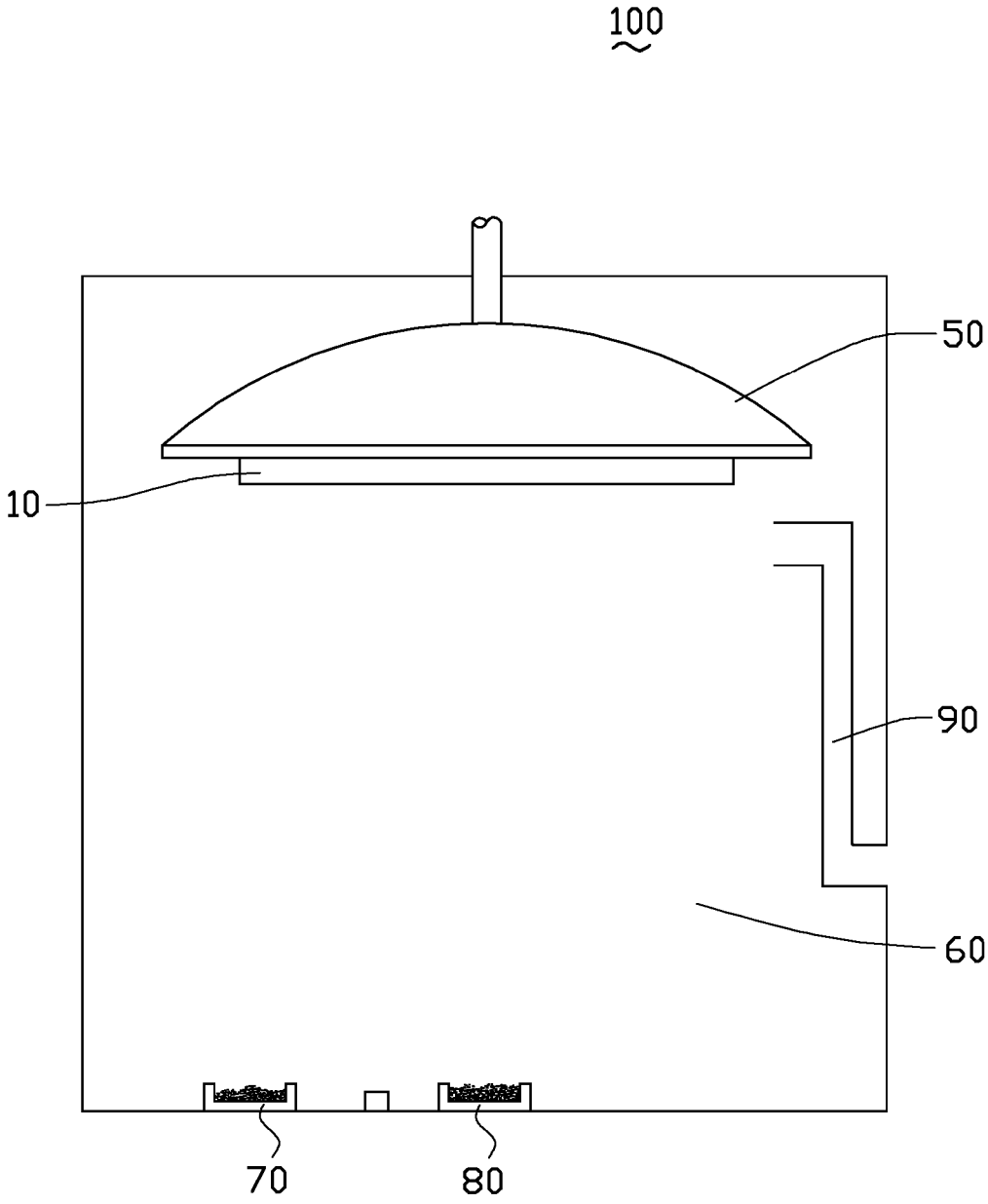
FIG. 3 is a schematic view of a magnetron sputtering coating machine for manufacturing the article in FIG. 2.

Referring to FIG. 3, a method for manufacturing the article 40 may include at least the following steps.

Providing a substrate 10. The substrate 10 may be made of high speed steel, hard alloy, or stainless steel.

Pretreating the substrate 10 by washing with a solution (e.g., alcohol or acetone) in an ultrasonic cleaner, to remove, e.g., grease, dirt, and/or impurities, then drying the substrate 10. Then the substrate 10 is cleaned by argon plasma cleaning. The substrate 10 is retained on a rotating bracket 50 in a vacuum chamber 60 of a magnetron sputtering coating machine 100. The vacuum level of the vacuum chamber 60 is set to about $8.0\times10^{-3}$ Pa. Argon is floated into the vacuum chamber 60 at a flux of about 300 standard cubic centimeters per minute (sccm) to 600 sccm from a gas inlet 90. Then a bias voltage is applied to the substrate 10 in a range of about −300 volts to −800 volts for about 3-10 minutes. Thereby, the substrate 10 is washed by argon plasma, to further remove any grease or dirt. Thus, the binding force between the substrate 10 and the bonding layer 20 is enhanced.

In depositing a bonding layer 20 on the substrate 10, the temperature in the vacuum chamber 60 is set to between about 150 degrees Celsius (° C.) and about 300° C. Argon is floated into the vacuum chamber 60 at a flux of about 150 sccm to 300 sccm from the gas inlet 90. In this exemplary embodiment the flux is about 150 sccm. The substrate 10 is rotated at about 1.0 revolution per minute (rpm) to 3 rpm. A power source applied to a zirconium yttrium alloy target 70 and a zirconium target 80 may both be in a range of about 20 amperes (A) to about 100 A. A bias voltage applied to the substrate 10 may be in a range of about −100 volts to −300 volts for about 5 min to about 15 min, to deposit the bonding layer 20 on the substrate 10. The zirconium yttrium alloy target contains atomic zirconium in a range about 70 to about 90 wt %.

In depositing the nano-composite layer 31 on the bonding layer 20, nitrogen is floated into the vacuum chamber 60 at a flux of about 10 sccm to about 200 sccm and argon is floated into the vacuum chamber 60 at a flux of about 150 sccm to 300 sccm from the gas inlet 90. The zirconium yttrium alloy target 70 and the zirconium target 80 in the vacuum chamber 60 are alternatively evaporated for about 60 min to about 120 min, to alternatively deposit an equal number of alternating ZrN layers 311 and ZrYN layers 313 on the bonding layer 20.

The color layer 33 may be deposited on the nano-composite base 31 to improve the appearance of the article 40.

During depositing the ZrYN layers 313, atomic yttrium can react with atomic zirconium to form solid solution alloy. Atomic yttrium cannot react with atomic nitrogen but can react with atomic zirconium to form zirconium-nitrogen crystals. Atomic yttrium is independently located at the boundary of the zirconium-nitrogen crystals, which can prevent the zirconium-nitrogen crystals from enlarging, to maintain the zirconium-nitrogen crystals at a nanometer level. The nanometer level zirconium-nitrogen crystals can improve durability of the coating 30.

It is to be understood, however, that even through numerous characteristics and advantages of the exemplary disclosure have been set forth in the foregoing description, together with details of the system and function of the disclosure, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A coating, comprising:

a nano-composite layer comprising an equal number of alternating zirconium nitride layers and zirconium yttrium nitride layers;

wherein the number of the zirconium nitride layers is about 20~50.

2. The coating as claimed in claim 1, wherein each zirconium nitride layer has a thickness of about 10 nanometers to about 20 nanometers.

3. The coating as claimed in claim 1, wherein each zirconium yttrium nitride layer has a thickness of about 10 nanometers to about 20 nanometers.

4. The coating as claimed in claim 1, wherein the coating has a thickness of about 1 micrometer to about 4 micrometers.

5. The coating as claimed in claim 1, wherein the coating further comprises a color layer covering on the nano-composite layer, to decorate the appearance of the coating.

6. An article, comprising:

a substrate;

a bonding layer deposited on the substrate; and a coating deposited on the bonding layer, the coating including a nano-composite layer, the nano-composite layer comprising an equal number of alternating zirconium nitride layers and zirconium yttrium nitride layers;

wherein the number of the zirconium nitride layers is about 20~50.

7. The article as claimed in claim 6, wherein each zirconium nitride layer has a thickness of about 10 nanometers to about 20 nanometers.

8. The article as claimed in claim 6, wherein each zirconium yttrium nitride layer has a thickness of about 10 nanometers to about 20 nanometers.

9. The article as claimed in claim 6, wherein the coating has a thickness of about 1 micrometer to about 4 micrometers.

10. The article as claimed in claim 6, further comprising a color layer covering on the nano-composite layer.

11. The article as claimed in claim 6, wherein the substrate is made of high speed steel, hard alloy, or stainless steel.

12. The article as claimed in claim 6, wherein the bonding layer is a zirconium yttrium layer, the bonding layer has a thickness of about 0.05 micrometers to about 0.2 micrometers.

13. The article as claimed in claim 6, wherein the chemical stability of the bonding layer is between the chemical stability of the substrate and the chemical stability of the coating, and the coefficient of thermal expansion of the bonding layer is between the coefficient of thermal expansion of the substrate and the coefficient of thermal expansion of the coating.

14. The article as claimed in claim 6, wherein the coating contacts the bonding layer via one of the zirconium nitride layers.

15. A coating, comprising:

a nano-composite layer comprising a plurality of stacked films, wherein each film includes a zirconium nitride layer and a zirconium yttrium nitride layer, a number of the films is about 20~50.

16. The coating as claimed in claim 15, wherein each zirconium nitride layer has a thickness of about 10 nanometers to about 20 nanometers.

17. The coating as claimed in claim 15, wherein each zirconium yttrium nitride layer has a thickness of about 10 nanometers to about 20 nanometers.

18. The coating as claimed in claim 15, wherein the coating has a thickness of about 1 micrometer to about 4 micrometers.

* * * * *

UNITED STATES PATENT AND TRADEMARK OFFICE

CERTIFICATE OF CORRECTION

PATENT NO. : 8,142,912 B1
APPLICATION NO. : 13/031709
DATED : March 27, 2012
INVENTOR(S) : Hsin-Pei Chang et al.

It is certified that error appears in the above-identified patent and that said Letters Patent is hereby corrected as shown below:

Title Page,
Please replace Section (73) regarding "Assignees" on the front page of the Patent with the following:

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW).

Signed and Sealed this
Twenty-ninth Day of May, 2012

David J. Kappos

David J. Kappos
*Director of the United States Patent and Trademark Office*